US009711840B2

(12) United States Patent
Lin

(10) Patent No.: US 9,711,840 B2
(45) Date of Patent: Jul. 18, 2017

(54) ANTENNA STRUCTURE AND ELECTRONIC DEVICE USING THE SAME

(71) Applicant: Sercomm Corporation, Taipei (TW)

(72) Inventor: Feng-Yu Lin, Taipei (TW)

(73) Assignee: SERCOMM CORPORATION, Taipei (TW)

( * ) Notice: Subject to any disclaimer, the term of this patent is extended or adjusted under 35 U.S.C. 154(b) by 188 days.

(21) Appl. No.: 14/328,742

(22) Filed: Jul. 11, 2014

(65) Prior Publication Data

US 2015/0077303 A1 Mar. 19, 2015

(30) Foreign Application Priority Data

Sep. 13, 2013 (CN) ..... 2013 2 0567997 U

(51) Int. Cl.

*H01Q 9/28* (2006.01)
*H01Q 1/12* (2006.01)
*H01Q 9/26* (2006.01)

(52) U.S. Cl.

CPC ..... *H01Q 1/1207* (2013.01); *H01Q 9/26* (2013.01)

(58) Field of Classification Search

CPC ..... H01Q 1/12; H01Q 1/1228; H01Q 9/285
USPC ..... 343/702, 795, 878, 906, 720; 411/531
See application file for complete search history.

(56) References Cited

U.S. PATENT DOCUMENTS 4,513,292 A * 4/1985 Bowman ..... H01Q 9/285 343/795
4,825,220 A * 4/1989 Edward ..... H01Q 9/285 343/700 MS
5,532,707 A * 7/1996 Klinger ..... H01Q 19/108 343/793
6,072,439 A * 6/2000 Ippolito ..... H01Q 1/246 343/795
6,317,099 B1 * 11/2001 Zimmerman ..... H01Q 1/246 343/747
6,650,301 B1 * 11/2003 Zimmerman ..... H01Q 9/26 343/795
6,697,029 B2 * 2/2004 Teillet ..... H01Q 1/246 343/795
7,724,201 B2 * 5/2010 Nysen ..... H01Q 1/2275 343/700 MS
2004/0252070 A1 * 12/2004 Chuang ..... H01Q 9/26 343/795
2005/0110696 A1 * 5/2005 Surducan ..... H01Q 1/38 343/795
2007/0229385 A1 * 10/2007 Deng ..... H01Q 1/246 343/797
2008/0111757 A1 * 5/2008 Bisiules ..... H01P 5/103 343/799
2009/0115670 A1 * 5/2009 Nysen ..... H01Q 1/2275 343/702

(Continued)

*Primary Examiner* — Dameon E Levi
*Assistant Examiner* — Ab Salam Alkassim, Jr.
(74) *Attorney, Agent, or Firm* — McClure, Qualey & Rodack, LLP

(57) ABSTRACT

An antenna structure and an electronic device using the same are provided. The antenna structure includes an antenna body and a washer body. The antenna body includes an annular metal sheet. The washer body is connected to one side of the annular metal sheet. The washer body has a screw hole. The annular metal sheet surrounds the washer body, and the annular metal sheet extends upward from the washer body.

10 Claims, 6 Drawing Sheets

(56) References Cited

U.S. PATENT DOCUMENTS

| | | | | |
|---|---|---|---|---|
| 2010/0225555 | A1* | 9/2010 | Gunnels | H01Q 1/246 343/859 |
| 2010/0283694 | A1* | 11/2010 | Kato | G06K 19/07749 343/730 |
| 2011/0057852 | A1* | 3/2011 | Holland | H01Q 9/28 343/795 |
| 2015/0255882 | A1* | 9/2015 | Segador | H01Q 9/285 343/797 |

* cited by examiner

ANTENNA STRUCTURE AND ELECTRONIC DEVICE USING THE SAME

This application claims the benefit of People's Republic of China application Serial No. 201320567997.X, filed Sep. 13, 2013, the subject matter of which is incorporated herein by reference.

BACKGROUND

Field of the Invention

The disclosure relates in general to an antenna structure, and more particularly to an antenna structure with fixing function.

Related Art

As technology advances, wireless communication has been widely used in our daily life. An antenna is a necessary element in an ordinary communication electronic product. Moreover, the antenna occupies a certain amount of area in the communication electronic product. Thus there is a need for reducing the area the antenna occupies in order to make the communication electronic product small and light-weight.

SUMMARY

The disclosure is directed to an antenna structure and an electronic device using the same.

According to one aspect of the invention, an antenna structure is provided. The antenna structure includes an antenna body and a washer body. The antenna body includes an annular metal sheet. The washer body is connected to one side of the annular metal sheet. The washer body has a screw hole. The annular metal sheet surrounds the washer body, and the annular metal sheet extends upward from the washer body.

According to another aspect of the invention, an antenna structure is provided. The antenna structure includes an antenna body and a screw body. The antenna body includes an annular metal sheet. The screw body is connected to one side of the annular metal sheet. The annular metal sheet surrounds the screw body, and the annular metal sheet extends upward from the screw body.

According to another aspect of the invention, an electronic device is provided. The electronic device includes a circuit board, a case, an antenna structure and a screw. The antenna structure includes an antenna body and a washer body. The antenna body includes an annular metal sheet. The washer body is connected to one side of the annular metal sheet. The washer body has a screw hole. The annular metal sheet surrounds the washer body, and the annular metal sheet extends upward from the washer body. The screw passes through the screw hole of the washer body, and the screw fixes the antenna structure and the circuit board on the case.

According to another aspect of the invention, an electronic device is provided. The electronic device includes a circuit board, a case and an antenna structure. The antenna structure includes an antenna body and a screw body. The antenna body includes an annular metal sheet. The screw body is connected to one side of the annular metal sheet. The screw body fixes the circuit board on the case. The annular metal sheet surrounds the screw body, and the annular metal sheet extends upward from the screw body.

The invention will become apparent from the following detailed description of the preferred but non-limiting embodiments. The following description is made with reference to the accompanying drawings.

Figure 1:
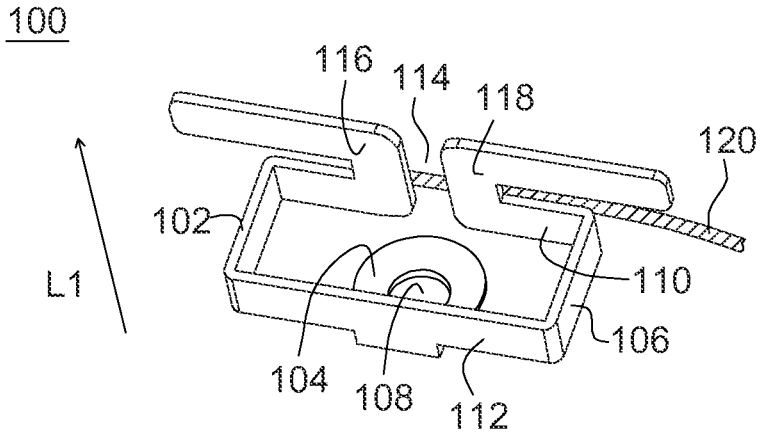
FIG. 1 shows a diagram of an antenna structure according to one embodiment of the invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

DETAILED DESCRIPTION

FIG. 1 shows a diagram of an antenna structure according to one embodiment of the invention. The antenna structure 100 includes an antenna body 102 and a washer body 104. The antenna body 102 includes an annular metal sheet 106. The washer body 104 is connected to one side of the annular metal sheet 106. The washer body 104 has a screw hole 108. The annular metal sheet 106 surrounds the washer body 104, and the annular metal sheet 106 extends upward from the washer body 104, for example, extending along the direction L1. The extending direction is not limited to the direction L1. It is within the scope of the present invention as long as the annular metal sheet 106 extends upward from the washer body 104.

The shape of the annular metal sheet 106 is substantially a rectangle, surrounding the washer body 104. The rectangular annular metal sheet 106 has a first long side 110 and a second long side 112. The first long side 110 is opposite to the second long side 112. There is a gap 114 located at the center of the first long side 110. One end of the gap 114 is adjacent to a first metal sheet 116, and the other end of the gap 114 is adjacent to a second metal sheet 118.

The first metal sheet 116 and the second metal sheet 118 are both electrically connected to a signal transmission line 120 so as to serve as a signal feeding point of the antenna structure 100. The signal transmission line 120 may be for example a radio-frequency (RF) cable, which transmits signals from a circuit board to the antenna structure 100 for signal emission or transmits signals received at the antenna structure 100 to the circuit board.

The first metal sheet 116 and the second metal sheet 118 have a symmetric bent structure, and the first metal sheet 116 and the second metal sheet 118 extend toward opposite directions. The extending direction is substantially parallel to the first long side 110. Moreover, the extending length of the first metal sheet 116 and the extending length of the second metal sheet 118 are equal, thus forming a symmetric structure.

The first metal sheet 116 and the second metal sheet 118 are electrically connected by the signal transmission line 120 to form a dipole antenna. The radiation frequency of the antenna structure 100 can be altered by adjusting the total length of the annular metal sheet 106, the first metal sheet 116 and the second metal sheet 118. The total length is roughly equal to half the wavelength of the radiation signal. The point where the signal transmission line 120 touches the first metal sheet 116 or the second metal sheet 118 serves as a signal feeding point. The location of the feeding point is not limited to the location illustrated in FIG. 1, but may also be other locations on the metal sheet. The location of the feeding point affects the impedance matching of the antenna structure 100.

The washer body 104 is connected to the second long side 112 of the annular metal sheet 106. The washer body 104 has a screw hole 108. The shape of the washer body 104 may be a circle, a square, a triangle, and so on. The shape of the washer body 104 does not affect the design of the antenna body 102. The washer body 104 may either be conductive or non-conductive, as long as it has the fixing function of a washer. The screw hole 108 can be adjusted according to the screw size and the screw specification adopted. The shape of the screw hole 108 may be a circle, a square, a hexagon and so on. The washer body 104 of the antenna structure 100 serves as a washer for a screw. Specifically, when the washer body 104 is used with a screw, it makes the screw attached to the object more tightly and more firmly such that the antenna structure 100 can be used for fixing and positioning in a communication electronic product.

The antenna structure 100 may also be electrically connected to the ground plane of the circuit board. In addition, the antenna structure 100 may be fixed on other components of an electronic device, such as a case or an an iron case. As long as the antenna structure 100 is electrically connected to the signal transmission line 120, it has a function of an antenna.

Because the antenna structure 100 includes the antenna body 102 and the washer body 104, it has both the function of a washer and the function of antenna radiation. The washer body 104 can be used with a screw to fix a first object on a second object, while the antenna body 102 can emit or receive wireless signals. In this embodiment, a washer and an antenna are integrated in a single element, thus the total cost and the total volume can be reduced effectively. Conventionally, the washer and the antenna are disposed on different regions of a circuit board, and each element occupies a certain area of the circuit board. Comparing with the conventional approach where a washer and an antenna are independent to each other, the antenna body 102 and the washer body 104 are disposed on the same region of the circuit board in this embodiment, and therefore the area of the circuit board can be saved effectively.

Furthermore, when installing a component on a circuit board, conventionally a fixing screw and an antenna are installed separately on the circuit board. It must take some work time to install the fixing screw and still some other work time to install the antenna. In this embodiment, however, only the antenna structure 100 has to be installed on the circuit board by a screw, the purpose of disposing the screw and disposing the antenna can be achieved simultaneously. Therefore the work time can be saved as compared with the conventional approach.

Figure 2A:
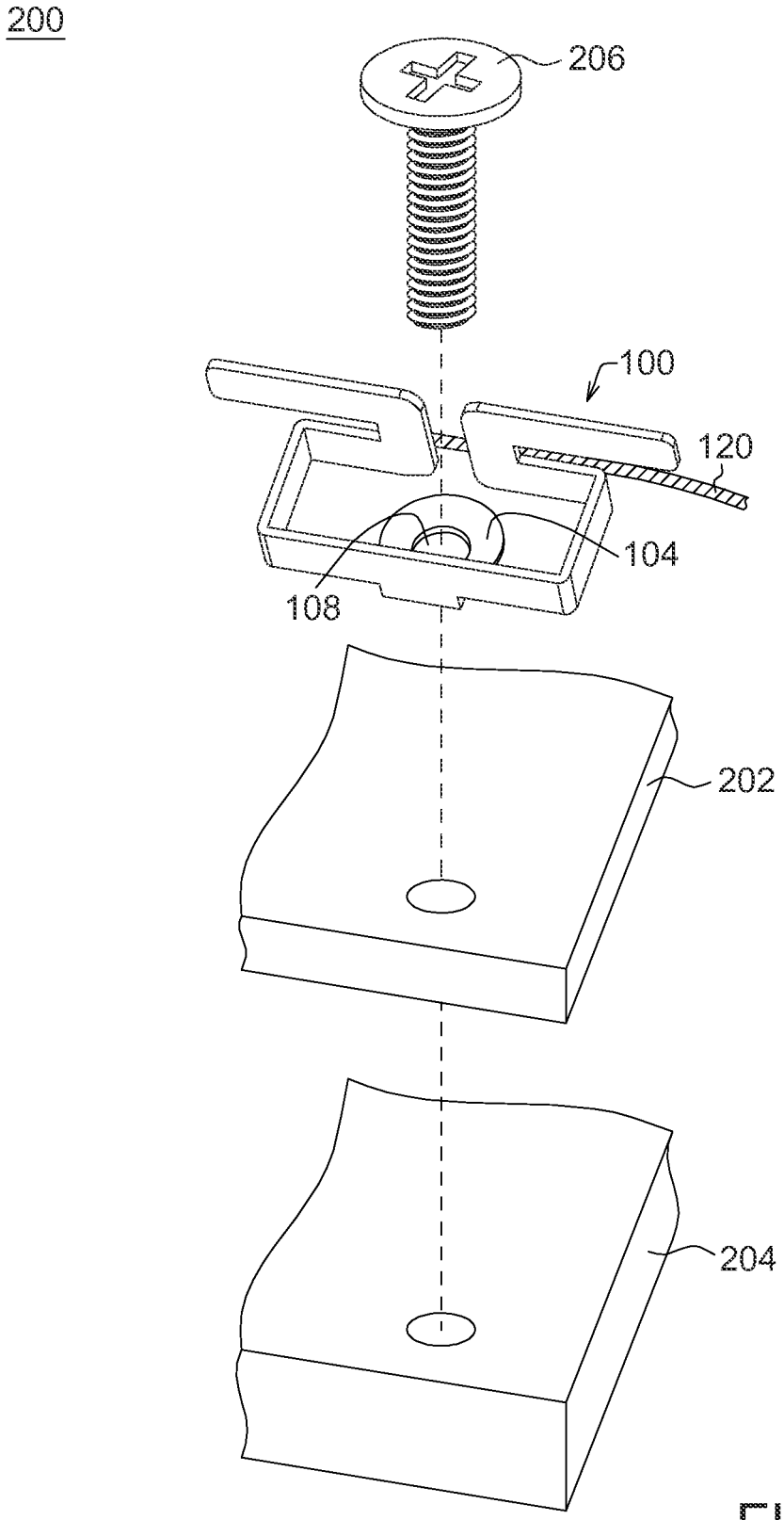
FIG. 2A and FIG. 2B show diagrams of an electronic device using the antenna structure according to one embodiment of the invention.
Figure 2B:
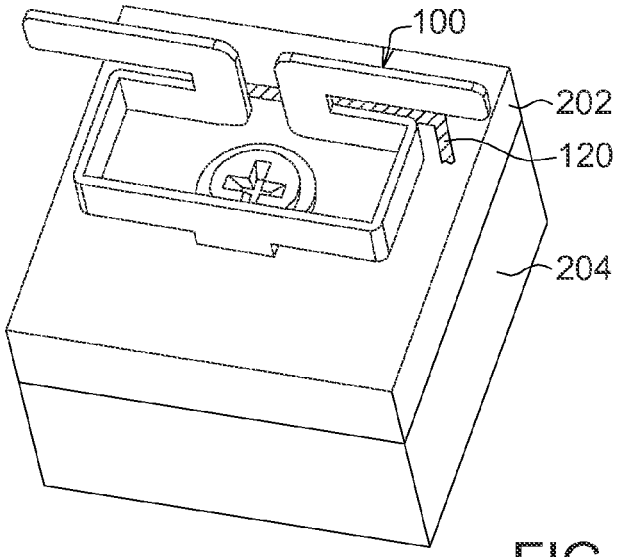

FIG. 2A and FIG. 2B show diagrams of an electronic device using the antenna structure according to one embodiment of the invention. The electronic device 200 includes a circuit board 202, a case 204, the antenna structure 100 and a screw 206. FIG. 2A shows the status before combining the antenna structure 100, the circuit board 202 and the case 204. When combining these elements, the screw 206 passes through the screw hole 108 of the washer body 104 to fix the antenna structure 100 and the circuit board 202 on the case 204. FIG. 2B shows the status after combining the antenna structure 100, the circuit board 202 and the case 204. After fixing the circuit board 202 on the case 204 by the screw 206 and the washer body 104, the antenna structure 100 has been disposed on the circuit board 202 as well. The signal transmission line 120 transmits signals from the circuit board 202 to feed in the antenna structure 100 so as to generate radiation signals. The signal transmission line 120 may also transmit signals received at the antenna structure 100 to the circuit board 202. The antenna structure 100 not only has a function of antenna radiation but also has a fixing function.

Figure 3:
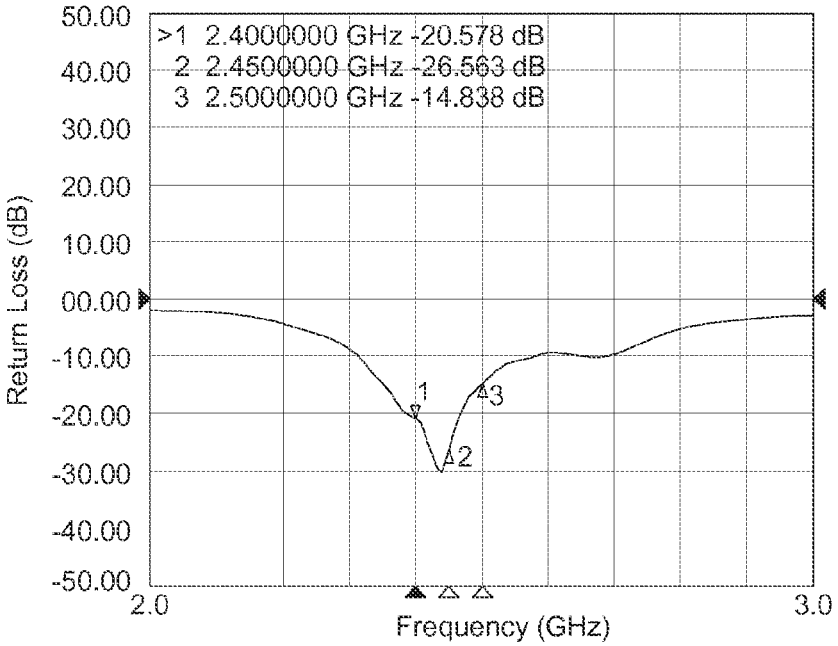
FIG. 3 shows a plot of the return loss measured according to one embodiment of the invention.

FIG. 3 shows a plot of the return loss measured according to one embodiment of the invention. Take −10 dB as the threshold value of the return loss, as shown in FIG. 3, the radiation frequency of the antenna in this embodiment is in the range of 2.4 GHz-2.5 GHz.

Figure 4:
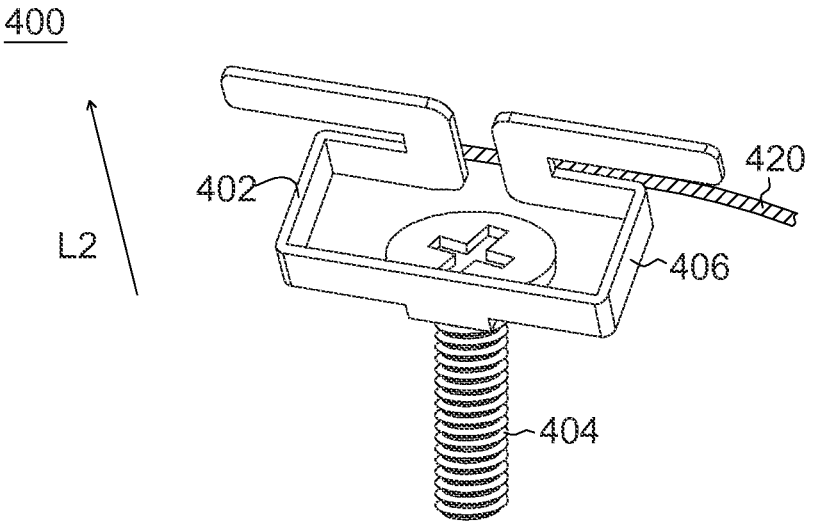
FIG. 4 shows a diagram of an antenna structure according to another embodiment of the invention.

FIG. 4 shows a diagram of an antenna structure according to another embodiment of the invention. The antenna structure 400 includes an antenna body 402 and a screw body 404. The antenna body 402 includes an annular metal sheet 406. The screw body 404 is connected to one side of the annular metal sheet 406. The annular metal sheet 406 surrounds the screw body 404, and the annular metal sheet 406 extends upward from the screw body 404, for example, extending along the direction L2. The extending direction is not limited to the direction L2. It is within the scope of the present invention as long as the annular metal sheet 406 extends upward from the screw body 404.

The difference between this embodiment and the antenna structure 100 in the previous embodiment is that the washer body 104 is replaced by the screw body 404, so that the antenna structure 400 includes the antenna body 402 and the screw body 404.

Due to the screw body 404, the antenna structure 400 serves as a screw that is capable of fixing objects. The screw body 404 may either be a conductor or a non-conductive material, such as a plastic screw, as long as it has a fixing function. The screw drive of the screw body 404 may be single slot, cross-recess, square, and so-on. The screw drive allows the user to use a corresponding screwdriver to turn the screw body 404, which means turning the entire antenna structure 400. The antenna structure 400, serving as a screw, can be used for fixing and positioning in a communication electronic product.

Figure 5A:
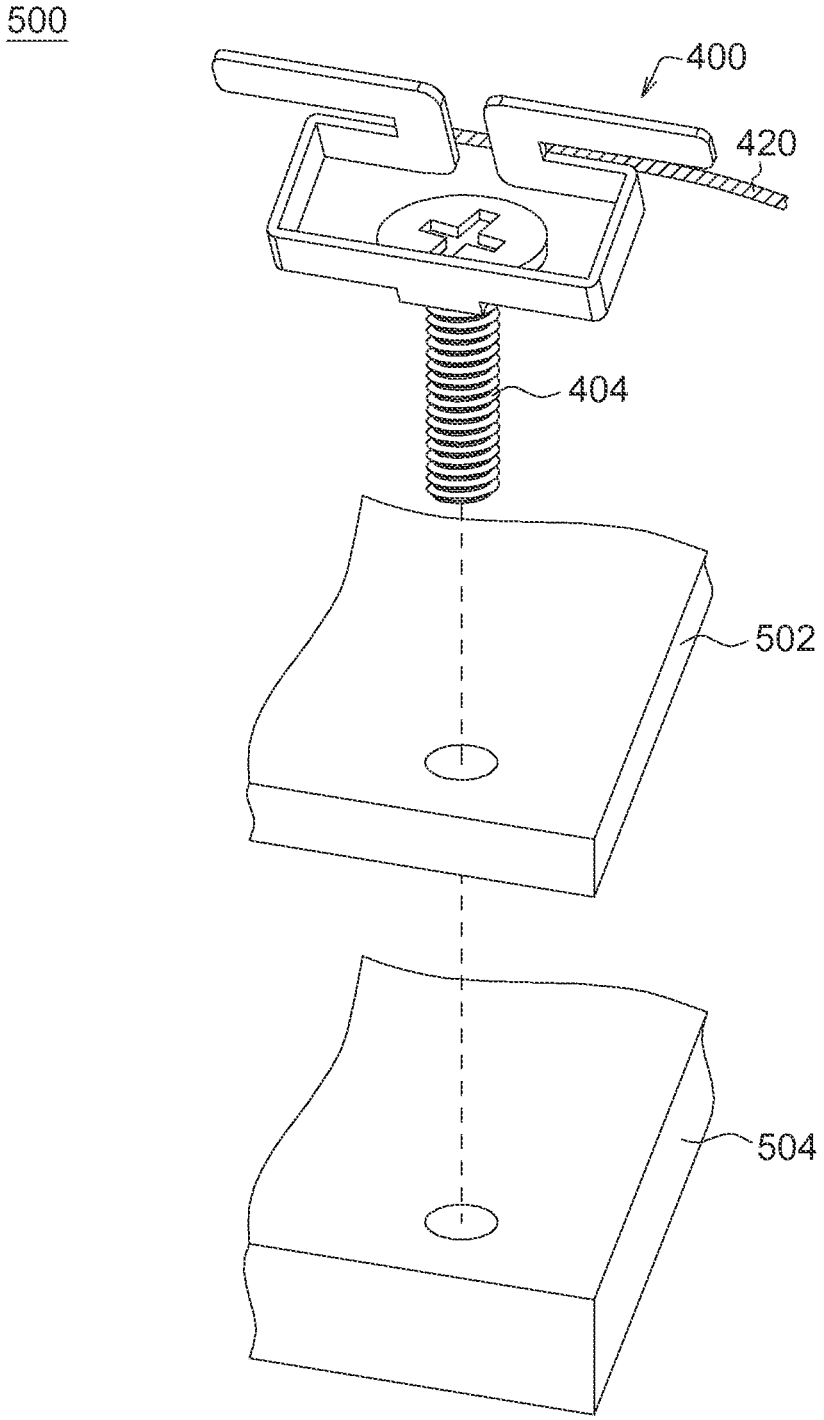
FIG. 5A and FIG. 5B show diagrams of an electronic device using the antenna structure according to another embodiment of the invention.
Figure 5B:
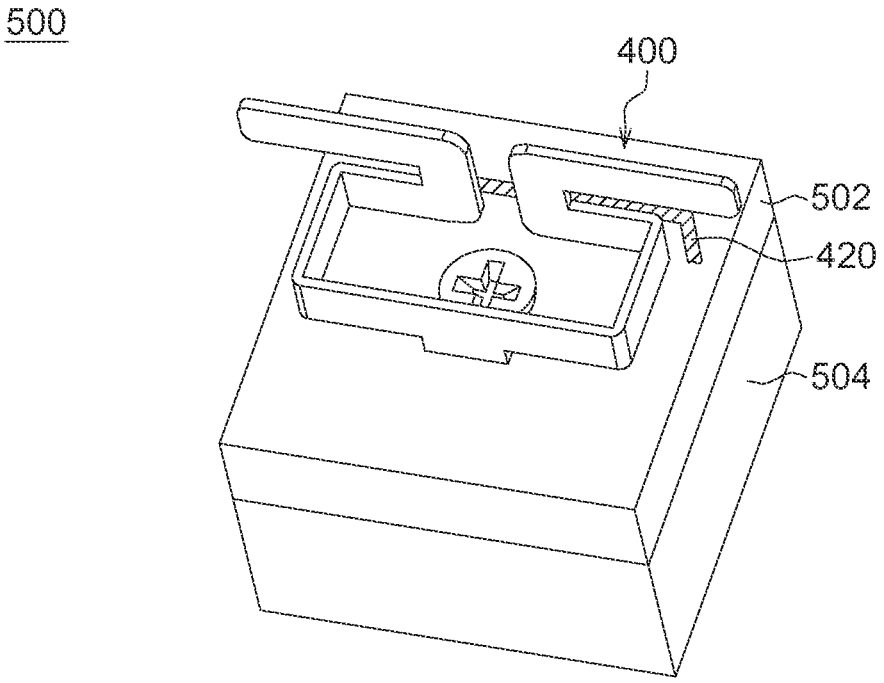

FIG. 5A and FIG. 5B show diagrams of an electronic device using the antenna structure according to another embodiment of the invention. The electronic device 500 includes a circuit board 502, a case 504 and the antenna structure 400. FIG. 5A shows the status before combining the antenna structure 400, the circuit board 502 and the case 504. The circuit board can be fixed on the case 504 by the screw body 404. FIG. 5B shows the status after combining the antenna structure 400, the circuit board 502 and the case 504. After fixing the circuit board 502 on the case 504 by the screw body 404, the antenna structure 400 has been disposed on the circuit board 502 as well. The signal transmission line 420 transmits signals from the circuit board 502 to feed in the antenna structure 400 so as to generate radiation signals. The signal transmission line 420 may also transmit signals received at the antenna structure 400 to the circuit board 502. In this embodiment, the screw body 404 may be electrically connected to the ground plane of the circuit board 502.

In summary, in this invention an antenna and a washer are designed as a single element such that the single element possesses both functions. Alternatively, an antenna and a screw are designed as a single element such that the single element possesses both functions. Compared with the conventional approach where a screw is used for fixing a circuit board, the antenna structure proposed in this invention possesses the characteristics of both an antenna and a washer (or a screw), and therefore the total cost and total volume of the antenna and the washer (or the screw) can be saved effectively. In addition, since the antenna and the washer (or the screw) are disposed in the same region on the circuit board, the area used on the circuit used on the circuit board can be further reduced. During the assembling process, after the antenna structure is combined with the circuit board and the case, the purpose of disposing the screw and disposing the antenna can be achieved simultaneously. Therefore the work time can be saved as compared with the conventional approach.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. An antenna structure, comprising:

an antenna body, comprising an annular metal sheet, wherein the shape of the annular metal sheet is substantially a rectangle having a first long side and a second long side opposite to the first long side; and a washer body, connected to one side of the annular metal sheet, the washer body having a screw hole;

wherein the annular metal sheet surrounds the washer body, the washer body is connected to the second long side, and the annular metal sheet extends upward from the washer body, wherein the antenna body is a dipole antenna, the antenna body further comprises a first metal sheet and a second metal sheet, the annular metal sheet has a gap located near the center of the first long side, the gap separates the first long side into a first half section and a second half section, the first metal sheet extends from the first half section at one end of the gap, and the second metal sheet extends from the second half section at the other end of the gap, wherein part of the first metal sheet and part of the second metal sheet extend toward opposing directions, the extending direction is parallel to the first long side, the length of the first metal sheet and the length of the second metal sheet are substantially equal.

2. The antenna structure according to claim 1, wherein the first metal sheet and the second metal sheet are both electrically connected to a signal transmission line.

3. An antenna structure, comprising:

an antenna body, comprising an annular metal sheet, wherein the shape of the annular metal sheet is substantially a rectangle having a first long side and a second long side opposite to the first long side; and a screw body, connected to one side of the annular metal sheet;

wherein the annular metal sheet surrounds the screw body, the screw body is connected to the second long side, and the annular metal sheet extends upward from the screw body, wherein the antenna body is a dipole antenna, the antenna body further comprises a first metal sheet and a second metal sheet, the annular metal sheet has a gap located near the center of the first long side, the gap separates the first long side into a first half section and a second half section, the first metal sheet extends from the first half section at one end of the gap, and the second metal sheet extends from the second half section at the other end of the gap, wherein part of the first metal sheet and part of the second metal sheet extend toward opposing directions, the extending direction is parallel to the first long side, the length of the first metal sheet and the length of the second metal sheet are substantially equal.

4. The antenna structure according to claim 3, wherein the first metal sheet and the second metal sheet are both electrically connected to a signal transmission line.

5. An electronic device, comprising:

a circuit board;

a case;

an antenna structure, comprising:

an antenna body, comprising an annular metal sheet, wherein the shape of the annular metal sheet is substantially a rectangle having a first long side and a second long side opposite to the first long side; and a washer body, connected to one side of the annular metal sheet, the washer body having a screw hole, wherein the annular metal sheet surrounds the washer body, the washer body is connected to the second long side, and the annular metal sheet extends upward from the washer body; and a screw, passing through the screw hole of the washer body, wherein the screw fixes the antenna structure and the circuit board on the case, wherein the antenna body is a dipole antenna, the antenna body further comprises a first metal sheet and a second metal sheet, the annular metal sheet has a gap located near the center of the first long side, the gap separates the first long side into a first half section and a second half section, the first metal sheet extends from the first half section at one end of the gap, and the second metal sheet extends from the second half section at the other end of the gap, wherein part of the first metal sheet and part of the second metal sheet extend toward opposing directions, the extending direction is parallel to the first long side, the length of the first metal sheet and the length of the second metal sheet are substantially equal.

6. The electronic device according to claim 5, wherein the first metal sheet and the second metal sheet are both electrically connected to a signal transmission line.

7. An electronic device, comprising:

a circuit board;

a case; and an antenna structure, comprising:

an antenna body, comprising an annular metal sheet, wherein the shape of the annular metal sheet is substantially a rectangle having a first long side and a second long side opposite to the first long side; and a screw body, connected to one side of the annular metal sheet, wherein the screw body fixes the circuit board on the case;

wherein the annular metal sheet surrounds the screw body, the screw body is connected to the second long side, and the annular metal sheet extends upward from the screw body, wherein the antenna body is a dipole antenna, the antenna body further comprises a first metal sheet and a second metal sheet, the annular metal sheet has a gap located near the center of the first long side, the gap separates the first long side into a first half section and a second half section, the first metal sheet extends from the first half section at one end of the gap, and the second metal sheet extends from the second half section at the other end of the gap, wherein part of the first metal sheet and part of the second metal sheet extend toward opposing directions, the extending direction is parallel to the first long side, the length of the first metal sheet and the length of the second metal sheet are substantially equal.

8. The electronic device according to claim 7, wherein the first metal sheet and the second metal sheet are both electrically connected to a signal transmission line.

9. The antenna structure according to claim 3, wherein the antenna body and the screw body are integrated in one piece.

10. The antenna structure according to claim 7, wherein the antenna body and the screw body are integrated in one piece.

* * * * *